US009074395B2

(12) United States Patent
Packer

(10) Patent No.: US 9,074,395 B2
(45) Date of Patent: Jul. 7, 2015

(54) REMOVABLE DOOR STOP

(71) Applicant: Michell Soares Packer, Wichita Falls, TX (US)

(72) Inventor: Michell Soares Packer, Wichita Falls, TX (US)

( * ) Notice: Subject to any disclaimer, the term of this patent is extended or adjusted under 35 U.S.C. 154(b) by 0 days.

(21) Appl. No.: 13/921,354

(22) Filed: Jun. 19, 2013

(65) Prior Publication Data

US 2014/0084605 A1 Mar. 27, 2014

Related U.S. Application Data

(60) Provisional application No. 61/708,012, filed on Sep. 30, 2012, provisional application No. 61/705,656, filed on Sep. 26, 2012.

(51) Int. Cl.
*E05C 17/54* (2006.01)
*E05C 19/18* (2006.01)
*E05C 17/00* (2006.01)

(52) U.S. Cl.
CPC ..... *E05C 19/182* (2013.01); *E05C 17/54* (2013.01)

(58) Field of Classification Search
USPC ..... 292/342, 343, DIG. 15
See application file for complete search history.

(56) References Cited

U.S. PATENT DOCUMENTS

| | | | | | |
|---|---|---|---|---|---|
| 4,968,281 | A | * | 11/1990 | Smith et al. | 446/369 |
| 5,288,257 | A | | 2/1994 | Zacherl | |
| 5,291,631 | A | * | 3/1994 | Schjoneman | 16/86 R |
| 5,501,494 | A | | 3/1996 | Willetts | |
| 5,542,723 | A | * | 8/1996 | Scharf | 292/289 |
| 5,794,871 | A | | 8/1998 | Willetts | |
| 5,810,404 | A | * | 9/1998 | Horne et al. | 292/288 |
| 5,873,146 | A | | 2/1999 | Mungo et al. | |
| D591,147 | S | | 4/2009 | Lorenzati | |
| 7,766,400 | B2 | | 8/2010 | Predebon | |
| 2006/0163888 | A1 | * | 7/2006 | Bowser | 292/343 |
| 2007/0126248 | A1 | * | 6/2007 | Mintz | 292/342 |
| 2009/0255085 | A1 | | 10/2009 | Lorenzati | |

FOREIGN PATENT DOCUMENTS

| | | | | | |
|---|---|---|---|---|---|
| GB | 2224949 | A | * | 5/1990 | A63H 3/00 |
| JP | 02008480 | A | * | 1/1990 | E05C 17/54 |

* cited by examiner

*Primary Examiner* — Carlos Lugo
(74) *Attorney, Agent, or Firm* — Braxton, Hilton & Perrone, PLLC; Zachary W. Hilton

(57) ABSTRACT

A door stop for mounting on a door, the door stop having two or more body segments. A first body segment of the door stop is connected to a second body segment of the door stop via a connector. In one mode of operation, when the door stop is mounted on a door, the first body segment protrudes beyond a surface of the door, preventing closure of the door. The door stop may be removably mounted to the top or side of a door.

3 Claims, 2 Drawing Sheets

REMOVABLE DOOR STOP

CROSS REFERENCE TO RELATED APPLICATIONS

This application claims the benefit of U.S. Provisional Application No. 61/708,012, filed Sep. 30, 2012, and U.S. Provisional Application No. 61/705,656, filed on Sep. 26, 2012, which are incorporated by reference herein.

PARTIAL WAIVER OF COPYRIGHT

All of the material in this patent application is subject to copyright protection under the copyright laws of the United States and of other countries. As of the first effective filing date of the present application, this material is protected as unpublished material.

However, permission to copy this material is hereby granted to the extent that the copyright owner has no objection to the facsimile reproduction by anyone of the patent documentation or patent disclosure, as it appears in the United States Patent and Trademark Office patent file or records, but otherwise reserves all copyright rights whatsoever.

BACKGROUND OF THE INVENTION

Technical Field of the Invention

The invention relates generally to a door stop apparatus and in particular, to a door stop having one or more segments wherein at least one of said segments is adjustable such that in one mode the door stop may be utilized to prevent the closure of a door to which it is attached, and in a second mode the door stop may be configured by a user to allow said door to freely close without obstruction.

BRIEF DESCRIPTION OF THE SEVERAL VIEWS OF THE DRAWINGS

A more complete understanding of the invention may be had by reference to the following detailed description of various embodiments when taken in conjunction with the accompanying drawings, wherein.

Figure 1:
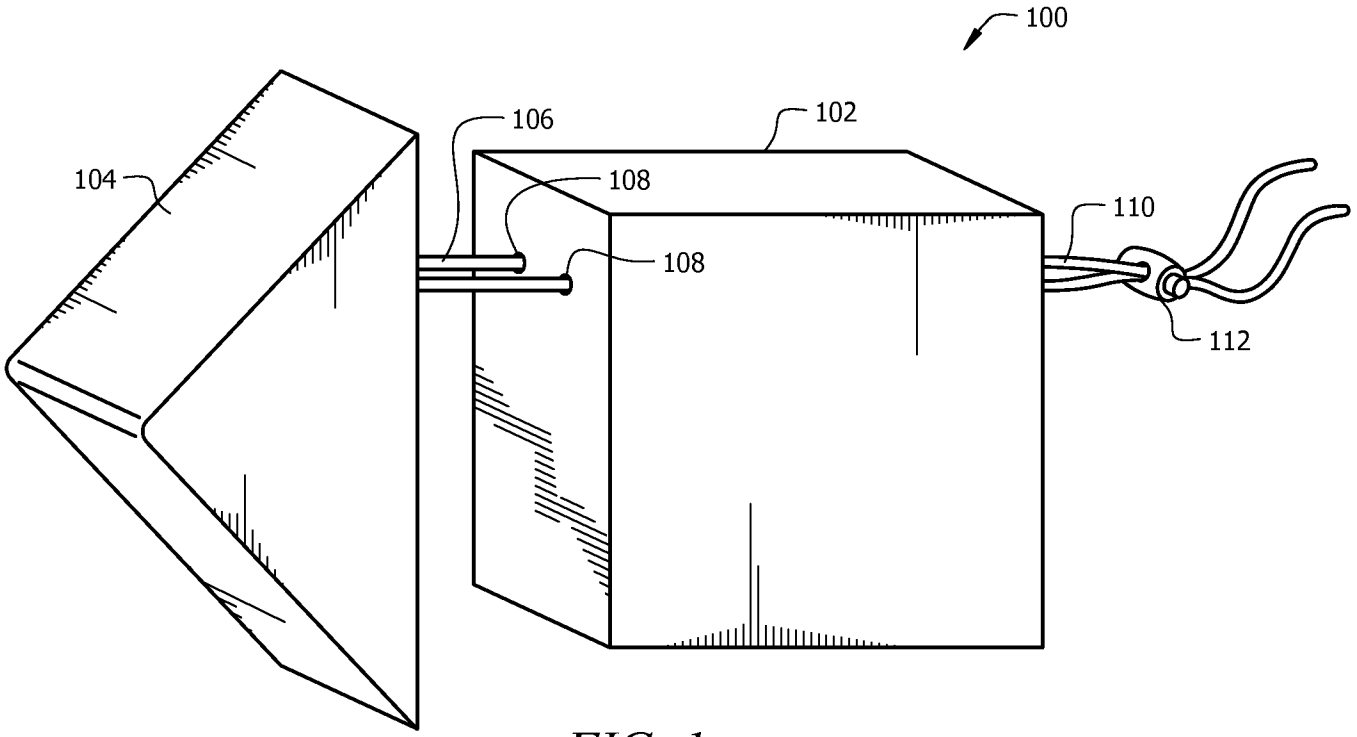
FIG. 1 shows a perspective view of a first embodiment of the door stop invention having two body segments connected by cords.

Where used in the various figures of the drawings, the same reference numerals designate the same or similar parts. Furthermore, when the terms "anterior," "posterior," "front," "rear," "aft," "forward," "first," "second," "upper," "lower," "height," "top," "bottom," "outer," "inner," "width," "length," "end," "side," "horizontal," "vertical," and similar terms are used herein, it should be understood that these terms have reference only to the structure shown in the drawing and are utilized only to facilitate describing the invention.

All figures are drawn for ease of explanation of the basic teachings of the invention only; the extensions of the figures with respect to number, position, relationship, and dimensions of the parts to form the preferred embodiment will either be explained or will be within the skill of persons of ordinary skill in the art after the following teachings of the present invention have been read and understood. Further, the exact dimensions and dimensional proportions to conform to specific width, length, and similar requirements will likewise be within the skill of the art after the following teachings of the invention have been read and understood.

DETAILED DESCRIPTION OF THE DRAWINGS

Several embodiments of Applicant's invention will now be described with reference to the drawings. In most cases, the items being discussed below correlate to a figure and a reference numeral appearing on the attached drawings.

Referring now to FIG. 1, one embodiment (100) of the invention is comprised of a soft block-like triangular (104) (as referred to as a "first body segment") and separate square shaped FIG. 102) (also referred to as a "second body segment"), whose exact size can vary and not disrupt its function. The figures share cords (106) (also referred to as a "connector") which run twice thru each and whose thickness may also vary. Slightly above the center of the blocks, the cord initially enters (110) and exits (106) thru the square (102) and then triangular block (104), from a tunnel (108) slightly larger than the cord. Upon completion of the cords exit, it re-enters the same triangular and then square shaped figure thru a second identical tunnel (108). This process results in both ends of the cord flowing freely from the square block. The cord contains an adjustable-like clip (112) that allows for the stopping, heightening or lowering of the blocks. Although sharing a string, the blocks can be individually navigated in either direction. This creation works as a whole, by the cord aligning the blocks and the adjustable clip holding the blocks in place by preventing any more string to pass thru it. This in turn limits the amount of space provided in between the two blocks holding the door and after the square block where the clip rests securely behind.

The invention is applied to the top of the door (not shown) by holding the triangular block (104) in one hand and the square (102) in the other, while gently pulling in opposite directions. The objective is to create enough space (107) to allow for the contraption (100) to fit firmly on the door top. The adjustable clip (112) will aid in the process of securing a proper fit, by allowing for more or less space. The exact placement of the contraption on the door top is a matter of preference; however the direction the two figures face is vital for its full use. Therefore, the triangular block must be placed on the front of the door facing its frame. The triangle's flat side must press firmly against the door with the center band running over the top of the door, back into the square. The flat side of the square block is pressed against the back of door facing the wall. The two should be aligned, with the triangle resting slightly higher than the square. Use the adjustable clip as needed to secure its position. When correctly installed, the bumpers will form an arrow pointing forward.

The height of the triangle (104) exceeds the height of the door, allowing for a gentle bump on the door frame and prevention of its closing when pushed forward. The length of the square (102) is longer than that of the door knob, to ensure it bumps the wall (not shown) before the doors knob does when pushed backwards. When the invention is properly installed, the internal cords pull the blocks towards one another and the clip (112) locks them into place. When only the desire to not close the door is intended, reverse the direction of the figures with the square (102) facing the door frame and the triangle facing the wall. When the 'reverse mode' has been properly installed, it will form an arrow pointing to the wall. Again, this only acts as a stop from door closure and not a guard against the knob striking the wall. When applied on 'over the door mode', the door can be closed without the removal of the invention by sliding the adjustable clip downward. By doing so, this allows for the lowering of the blocks onto both sides of the door and ultimately the collapse of the contraption. Close the door as usual. For later use, slide the adjustable clip up the cord to the appropriate width and align as needed.

The invention can also be applied to the side of the door, by creating one loop located before the triangle and one behind the square figure. Place the first loop belonging to the triangle, around the front door knob and the second loop around the back door knob. The center band (106) should wrap over the strike plate and latch mechanism. After doing so, adjust the clip as need to secure the subject into place. When the need to close the door while on the 'side of the door mode' becomes necessary, it can be done so without the removal of the contraption. Take one loop off either knob, allowing for the invention to hang under the attached knob. Close door as usual.

With the top of door application, its retracting ability allows for closure of the door at the operators discretion without its removal. This particular setting also provides out of reach from children and pets. The side of door application also provides the same door and wall protection, but for those who prefer a lower placement. In addition, this mode offers the ability to close the door with one loop still attached to either knob. Both settings can reverse the direction of the blocks, providing only an inability to close the door, if needed.

Figure 2:
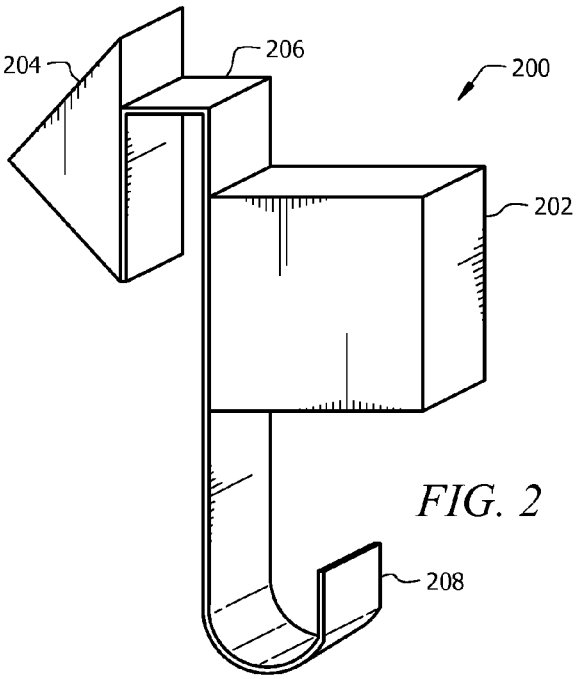
FIG. 2 shows a perspective view of an alternate embodiment of the door stop invention.
Figure 3:
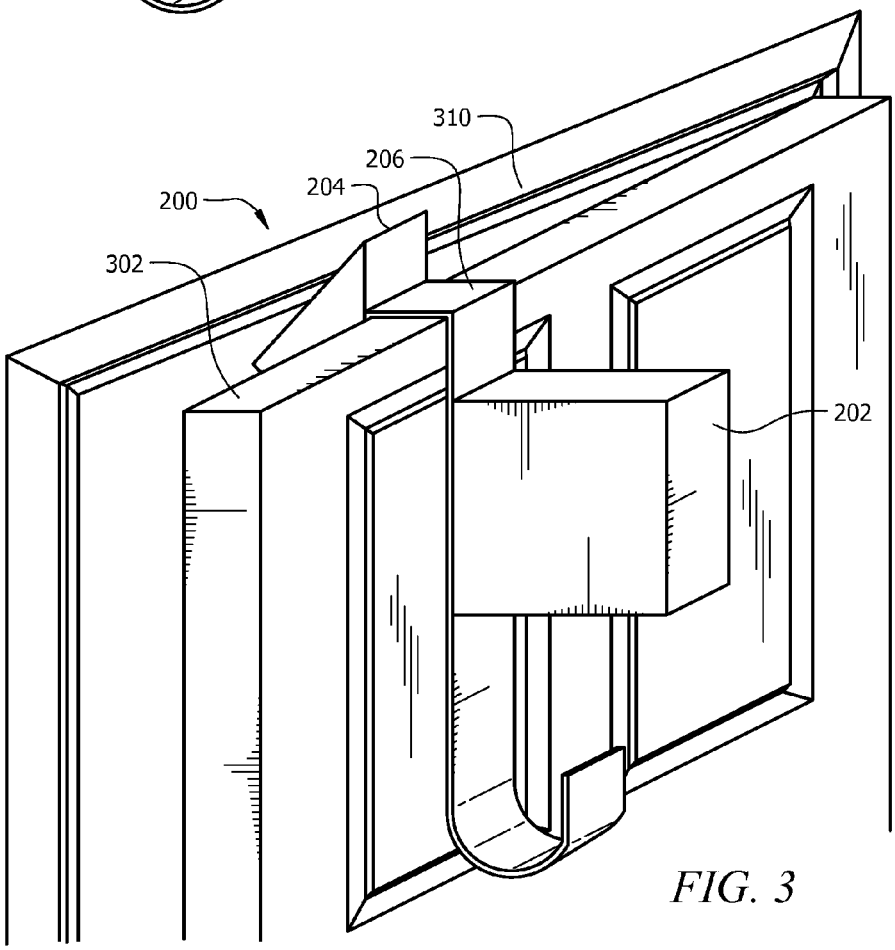
FIG. 3 shows a perspective view the alternate embodiment of the door stop invention shown at FIG. 2, said embodiment being mounted on the top of a door.

Referring now to FIG. 2 and FIG. 3, perspective views of an alternate embodiment (200) of the invention (may be referred to as a "bumper" herein) is shown. The alternate embodiment (200) shown at FIG. 2 and FIG. 3 is configured to be a firm bar-like structure (also referred to as a "connector"), whose appearance can be described as both flat and straight with two curved ends. The invention was created to restrict a door's range of motion. Thus, hindering its ability to be vigorously opened or closed. The curved ends serve as hooks and are facing away from one another. This bar-like component serves as the foundation, by ultimately providing a base for two delicate yet durable block-like figures to merge with. Molded into a triangular (204) and rectangular (202) design, the blocks (202, 204) are adjacent to one another on the bar (206). The triangular piece (204) points forward with the flat side connected to the outer part of the upside down hook, while the rectangular shaped piece (202) can be found behind its counterpart with its flat side connected to the bar (206). It is imperative the triangular part be situated higher than the top of the hook it is conjoined to, in order to block the door from closing. It is also critical the rectangular piece be positioned with the longer side facing out and away from the bar, to ensure it bumps the wall before the door knob can. The dimension of the components set forth, may vary as long as the requirements for both the triangular and rectangular parts have been met.

Referring now to FIG. 3, showing how the bumper is installed without the need of assembly, tools, hardware or any other special preparations. When ready to use, select desired mode and position bumpers accordingly. Top hook (206) is used to attach contraption to the door (302), regardless of application mode. Bottom hook (208) serves as both a handle for positioning invention on door top as well as a hanger for various items.

The bumper (200) shown in FIG. 3 has at least the four following modes:

Original Door Top Forward Position-Triangular bumper against front of door and rectangular bumper against back of door Reverse Door Top Position (closed door)—Triangular bumper against back of door and rectangular bumper against front of door Original Door Side Forward Position—Triangular bumper against front of door and rectangular bumper against back of door with bar over knobs Reverse Door Side Position (closed door)—Triangular bumper against back of door and rectangular bumper against front of door with bar over knobs Some Advantages of Invention:

The bumper's (200) different installation settings or "modes" allow for easy application. Those benefiting from its use include: disabled individuals, parents, pet owners as well as guests or family members who have a tendency to vigorously open and close doors. It aids in child proofing by preventing injury from hinge and outer area of door. Optimal protection to the door, wall and surrounding areas is also greatly achieved with its proper and continuous use.

It should be noted that the description of the present invention has been presented for purposes of illustration and description, and is not intended to be exhaustive or limited to the invention in the form disclosed. Many modifications and variations will be apparent to those of ordinary skill in the art. The preferred embodiment appearing in the drawings was chosen and described in order to best explain the principles of the invention, the practical application, and to enable others of ordinary skill in the art to understand the invention for various embodiments with various modifications as are suited to the particular use contemplated. It will be understood by one of ordinary skill in the art that numerous variations will be possible to the disclosed embodiments without going outside the scope of the invention as disclosed in the claims.

I claim:

1. A door stop positioned on a top of a door for preventing closing of the door against a door frame comprising:

a first body segment;

a second body segment; and a connector having a first end attached to the first body segment, the second body segment having a tunnel allowing the connector to pass through the second body segment, locking means positioned at a second end of the connector for fixedly securing the door stop in a desired adjustment;

wherein, in a first mode of operation, the first and second body segments are fixedly secured on the top of the door at a first adjustment position, the height of the first body segment configured to contact the door frame, preventing closure of the door;

wherein, in a second mode of operation, the first body segment is freely moved downward, allowing the door to be closed, and is returned and fixedly secured in a second adjustment position, preventing the door from being opened.

2. The door stop of claim 1, wherein said connector comprises one or more cords.

3. The door stop of claim 1 wherein, if the door is moved in the direction of the second body segment, an end of the second body segment is configured to contact a wall, preventing damage to said wall.

* * * * *